US010670209B1

(12) United States Patent
Guo

(10) Patent No.: US 10,670,209 B1
(45) Date of Patent: Jun. 2, 2020

(54) INTERIOR ROTATING STRUCTURE OF HANDICRAFT LANTERN

(71) Applicant: Xuehua Guo, Shanghai (CN)

(72) Inventor: Xuehua Guo, Shanghai (CN)

( * ) Notice: Subject to any disclaimer, the term of this patent is extended or adjusted under 35 U.S.C. 154(b) by 0 days.

(21) Appl. No.: 16/444,400

(22) Filed: Jun. 18, 2019

(51) Int. Cl.

| | |
|---|---|
| ***F21S 10/06*** | (2006.01) |
| ***F21L 19/00*** | (2006.01) |
| ***F21V 15/01*** | (2006.01) |
| ***F21V 21/30*** | (2006.01) |
| ***F21V 14/02*** | (2006.01) |
| *F21V 37/00* | (2006.01) |
| *F21V 31/00* | (2006.01) |

(52) U.S. Cl.
CPC ..... *F21S 10/063* (2013.01); *F21L 19/00* (2013.01); *F21V 14/025* (2013.01); *F21V 15/01* (2013.01); *F21V 21/30* (2013.01); *F21V 31/005* (2013.01); *F21V 37/0008* (2013.01)

(58) Field of Classification Search
CPC ..... F21S 10/002; F21L 19/00
See application file for complete search history.

(56) References Cited

U.S. PATENT DOCUMENTS 6,746,131 B1 * 6/2004 Goldstein ..... F21S 10/002 362/86
2017/0102130 A1 * 4/2017 Hu ..... F21L 4/00

* cited by examiner

*Primary Examiner* — Robert J May
(74) *Attorney, Agent, or Firm* — Frank H. Foster; Kremblas & Foster

(57) ABSTRACT

An interior rotating structure of a handicraft lantern comprises a lantern bracket, a transparent container, a sealed rotary mechanism, a mounting frame, a rear cover, and a motor body. The transparent container is fixed under the lantern bracket and the sealed rotary mechanism is inserted under the transparent container. The mounting frame is under the sealed rotary mechanism. A container sealing cover is installed in the sealed rotary mechanism, while a central impeller is mounted on the container sealing cover. The rotating structure includes a rotating gear and a shaft magnet on the motor shaft, so that the rotating gear drives a large inner ring gear to spin through multi-step transmission of a reduction gear set. The inner ring gear drives an impeller rotating bracket to rotate through the magnets, in such a way that the rotating bracket can agitate the liquid when the central impeller revolves at the same time.

9 Claims, 4 Drawing Sheets

INTERIOR ROTATING STRUCTURE OF HANDICRAFT LANTERN

TECHNICAL FIELD

The invention belongs to the technical field of lantern crafts and in particular relates to the interior rotating structure of a handicraft lantern.

BACKGROUND TECHNIQUES

Craft lanterns are a type of decorative lamp. Due to the rapid development of technology, the market is also constantly evolving with a variety of lanterns available. Despite the variety of lanterns in the market there are still some shortcomings, such as:

1. The interior of a traditional handicraft lantern cannot move. A less than satisfactory viewing effect makes it dull and reduces its decorative value as an ornamental handicraft.
2. Traditional handicraft lanterns contain some liquid, which will leak when the sealing is poor.

Thus, I have proposed the interior rotating structure of a handicraft lantern as a solution for the aforementioned problems.

SUMMARY

The invention is an interior rotating structure of a handicraft lantern. The interior rotating structure comprises a lantern bracket, a transparent container, a sealed rotary mechanism, a mounting frame, a rear cover, and a motor body. The transparent container is fixed under the lantern bracket and the sealed rotary mechanism is inserted under the transparent container. The mounting frame is set under the sealed rotary mechanism, with the rear cover planted at the bottom end of the mounting frame. A container sealing cover is installed in the sealed rotary mechanism, while a central impeller is mounted on the container sealing cover. The interior rotating structure of the craft lantern includes a rotating gear and a shaft magnet set on the motor shaft, so that the rotating gear drives a large inner ring gear to spin through multi-step transmission of a reduction gear set. Moreover, the inner ring gear drives an impeller rotating bracket to rotate through the first magnets and the second magnets, in such a way that the interior rotating bracket can agitate the liquid when the central impeller revolves at the same time.

DESCRIPTION OF DRAWINGS/FIGURES

Figure 1:
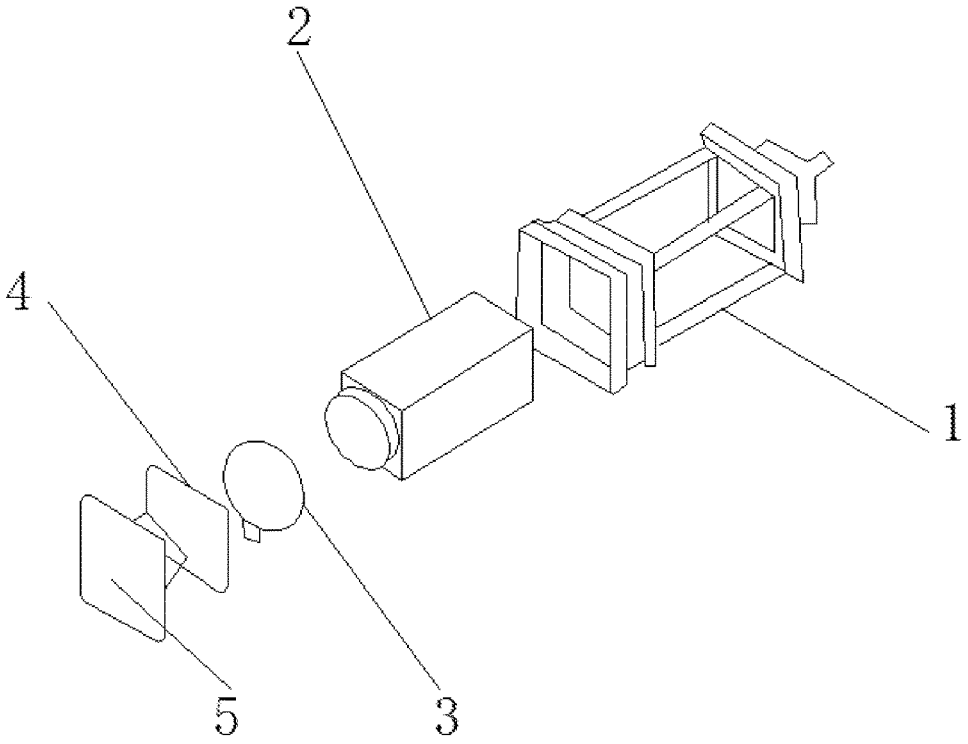
FIG. 1 shows a diagram of the overall disassembly structure of this invention.

In the figures: 1, lantern bracket; 2, transparent container; 3, sealed rotary mechanism; 4, mounting frame; 5, rear cover; 6, interior rotating bracket; 7, magnetic rotor; 8, central impeller frame; 9, container sealing cover; 10, central impeller; 11, motor shaft; 12, inner ring gear; 13, motor bracket; 14, motor body; 15, shaft magnet; 16, magnet impeller; 17, impeller rotating bracket; 18, fixing rod; 19, interior rotor; 20, rotating gear; 21, reduction gear set; 22, transmission gear; 23, first magnets; 24, second magnets.

Invention Details

The invention aims to provide a solution for the immovability of existing traditional handicraft lanterns' interior structure, which reduces their decorative value, and address the problem that water in the interior will leak when it rotates to achieve the aforementioned aim, the invention provides the following technical solution: the interior rotating structure of a handicraft lantern, which comprises a lantern bracket, a transparent container, a sealed rotary mechanism, a mounting frame, a rear cover, and a motor body. The transparent container is fixed under the lantern bracket, while the sealed rotary mechanism is placed under the transparent container. The rear cover is planted at the bottom end of the mounting frame, a container sealing cover is installed inside the sealed rotary mechanism, and a central impeller is mounted on the container sealing cover. A central impeller frame is set outside the central impeller, an interior rotating bracket is fixed on the exterior of the central impeller frame, whereas a magnetic rotor is built at the bottom end of the interior rotating bracket. A motor shaft penetrates the container sealing cover, and the bottom end of the motor shaft is connected to the output end of the motor body through the motor bracket. A shaft magnet and a rotating gear are fixed on the outer side of the motor shaft, the outer side of the rotating gear is meshed and connected to a reduction gear set, while the outer side of the reduction gear set is meshed and connected to the transmission gears. The outer side of the transmission gears is meshed and connected with an inner ring gear, the first magnets are fixed on the outer side of the inner ring gear, and second magnets are mounted on the outer side of the first magnets. An impeller rotating bracket is placed on the outer side of the second magnets, while the interior rotating bracket is inserted on the outer and rear sides of the impeller rotating bracket. The rear side of the impeller rotating bracket is connected to the central impeller through a fixing rod. An interior rotor is fixed on the outer side of the interior rotating bracket, and a magnet impeller is set on the rear side of the impeller rotating bracket.

Preferably, the sealed rotary mechanism is T-shaped and connected to the motor bracket through screws.

Preferably, the interior rotating bracket and the sealed rotary mechanism form a rotating structure through the fan-shaped magnet rotor.

Preferably, the container sealing cover and the sealed rotary mechanism are integrated, with the container sealing cover linked to the central impeller frame through a sliding connection.

Preferably, the central impeller and the central impeller frame are configured to be detached through the fixing rod, the vertical central line of the fixing rod coincides with the vertical central line of the central impeller frame, and the outermost sides of the central impeller and magnetic rotor are not on the same plane.

Preferably, the inner ring gear is equally distributed inside the transmission gears, and the inner ring gear is fixed and connected to the impeller rotating bracket through the first magnets and impeller rotating bracket.

Preferably, the impeller rotating bracket forms a rotating structure through the sealed rotary mechanism and the inner ring gear, the side of the impeller rotating bracket is ring-shaped and is connected to the interior rotating bracket (6) through welding.

Preferably, the external diameter of each transmission gear is larger than or equal to that of the reduction gear set, with three transmission gears installed.

Preferably, the first magnets and the second magnets have different magnetic poles that make them attract.

Compared with prior craft, the benefits of this invention include the interior rotating lighting structure:

(1) A rotating gear and a shaft magnet are set on the motor interior, so that the rotating gear drives a large inner ring gear to spin through multi-step transmission of a reduction gear set. Moreover, the inner ring gear drives an impeller rotating bracket to rotate through the first magnets and second magnets, in such a way that the interior rotating bracket agitates the liquid when the central impeller revolves at the same time. At the same time, the shaft magnet on the motor shaft attracts the magnet impeller on the central impeller through the container sealing cover, whereby the central impeller rotates, enabling the central impeller to agitate the liquid in the transparent container. As a result, the impeller rotating bracket drives the interior rotating bracket to spin, so that the interior rotation of the lantern is realized and thereby improving the lantern's decorative value.

(2) The combination of the sealed rotary mechanism and container sealing cover makes the whole structure more water-tight. Moreover, mutual attraction between the first magnets and second magnets makes the inner ring gear rotate to drive the impeller rotating bracket, whereby the impeller rotating bracket further enables the interior rotating bracket to revolve. The shaft magnet and magnet impeller together drive the central impeller to rotate, preventing the motor shaft from directly driving the central impeller to revolve. This improves the sealing of the entire structure to avoid liquid leakage in the transparent container during rotation, and the device can be better used.

Specific Implementation Method

The invention will be described in detail with reference to the drawings and examples. It should be noted that the described examples are only a part of the invention. All other examples that technicians made without any creative efforts shall be included in the protection scope of the present invention.

As shown in FIGS. 1-7, the invention refers to an interior rotating structure of a handicraft lantern, comprising a lantern bracket 1, a transparent container 2, a sealed rotary mechanism 3, a mounting frame 4, a rear cover 5, an interior rotating bracket 6, a magnetic rotor 7, a central impeller frame 8, a container sealing cover 9, a central impeller 10, a motor shaft 11, an inner ring gear 12, a motor bracket 13, a motor body 14, a shaft magnet 15, a magnet impeller 16, an impeller rotating bracket 17, a fixing rod 18, an interior rotor 19, a rotating gear 20, a reduction gear set 21, a transmission gear 22, first magnets 23, and second magnets 24. The transparent container 2 is fixed under the lantern bracket 1, the sealed rotary mechanism 3 is inserted under the transparent container 2, the rear cover 5 is planted at the bottom end of the mounting frame 4, the container sealing cover 9 is installed inside the sealed rotary mechanism 3, and the central impeller 10 is mounted on the container sealing cover 9. The central impeller frame 8 is installed on the exterior of the central impeller 10, the interior rotating bracket 6 is planted on the outer side of the central impeller frame 8, the magnet rotor 7 is built at the bottom end of the interior rotating bracket 6, the motor shaft 11 penetrates the container sealing cover 9, and the bottom end of the motor shaft 11 is connected to the output end of the motor body 14 through the motor bracket 13. The shaft magnet 15 and rotating gear 20 are fixed on the outer side of the motor shaft 11, the exterior of the rotating gear 20 is meshed and connected to the reduction gear set 21, while the outer side of the reduction gear set 21 is meshed and connected to transmission gears 22. The outer side of the transmission gears 22 is meshed and connected to the inner ring gear 12, the first magnets 23 are fixed on the outer side of the inner ring gear 12, and second magnets 24 are mounted on the outer side of the first magnets 23. The impeller rotating bracket 17 is placed on the outer side of the second magnets 24, while the interior rotating bracket 6 is inserted on the rear and outer sides of the impeller rotating bracket 17. The rear side of the impeller rotating bracket 17 is connected to the central impeller 10 through the fixing rod 18. The interior rotor 19 is fixed on the outer side of the interior rotating bracket 6, and the magnet impeller 16 is set on the rear side of the impeller rotating bracket 17.

The sealed rotary mechanism 3 is T-shaped and connected to the motor bracket 13 through screws, with the entire structure better sealed owing to the mutual cooperation between the sealed rotary mechanism 3 and the motor bracket 13.

The interior rotating bracket 6 and sealed rotary mechanism 3 form a rotating structure through the fan-shaped magnetic rotor 7, whereby the interior rotating bracket 6 can drive the interior rotor 19 to rotate and adjust the lantern's interior.

The container sealing cover 9 and sealed rotary mechanism 3 are integrated, with the container sealing cover 9 linked to the central impeller frame 8, through a sliding connection, thereby improving the sealing performance of the container sealing cover 9 and sealed rotary mechanism 3.

The central impeller 10 and central impeller frame 8 are configured to be detached through the fixing rod 18, the vertical central line of the fixing rod 18 coincides with the vertical central line of the central impeller frame 8, and the outermost sides of the central impeller 10 and the magnetic rotor 7 are not on the same plane. This way, the central impeller frame 8 can drive the central impeller 10 to rotate.

The inner ring gears 12 are equally distributed on the transmission gears 22, and the inner ring gear 12 is fixed and connected to the impeller rotating bracket 17 through the first magnets 23 and the impeller rotating bracket 17. When the transmission gears 22 rotate, it can drive the inner ring gear 12 to spin as well.

The impeller rotating bracket 17 forms a rotating structure through the sealed rotary mechanism 3 and inner ring gear 12, the side of the impeller rotating bracket 17 is ring-shaped and connected to the interior rotating bracket 6 through welding, in which the inner ring gear 12 rotates and drives the impeller rotating bracket 17 to revolve.

The external diameter of each transmission gear 22 is larger than or equal to that of the reduction gear set 21, with three transmission gears installed. Therefore, the transmission gears 22 can drive the inner ring gear 12 while rotating.

The first magnets 23 and second magnets 24 have different magnetic poles that make them attract. With the first magnets 23 and the second magnets 24 set this way, it facilitates the fixed rotation of the inner ring gear 12 and the impeller rotating bracket 17.

Figure 2:
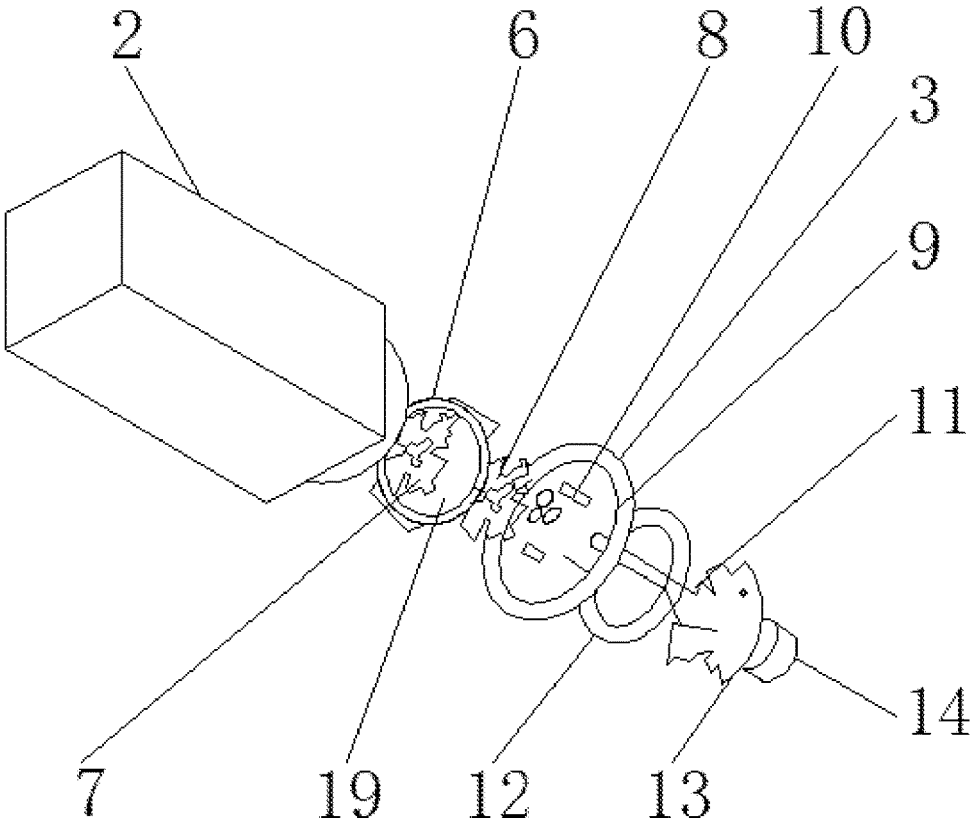
FIG. 2 shows a diagram of the internal structure of the invention's sealed rotary mechanism.
Figure 3:
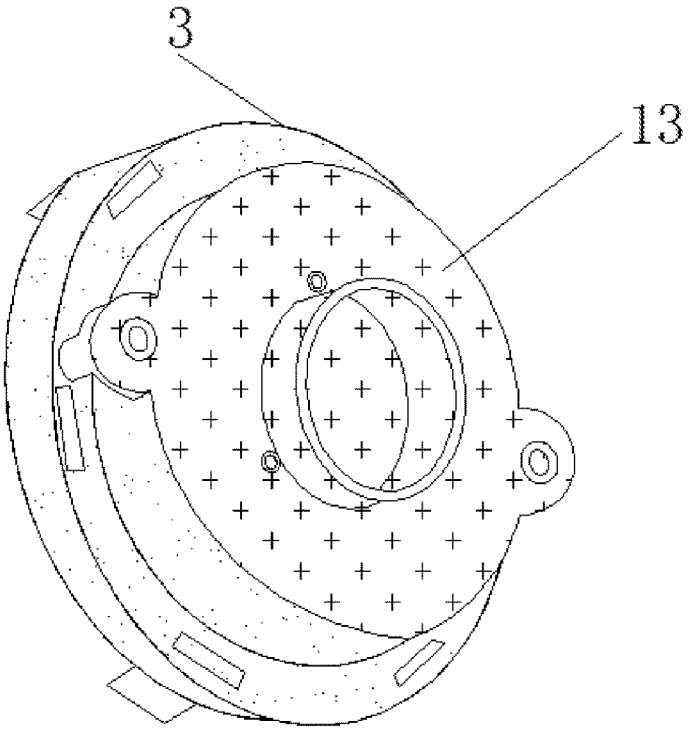
FIG. 3 shows the stereoscopic structure diagram of the invention's container sealing cover and sealed rotary mechanism.
Figure 4:
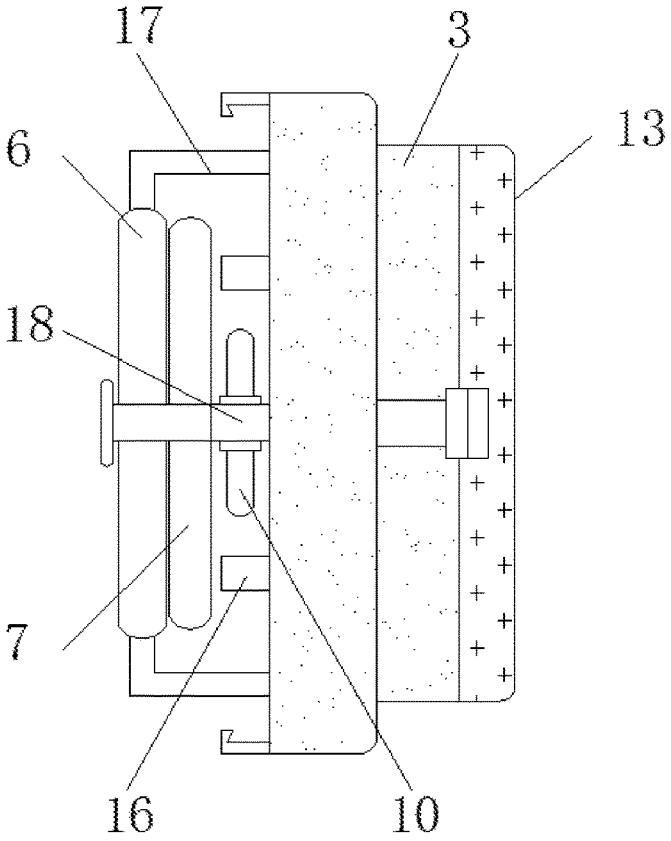
FIG. 4 shows the diagram of a side view of the invention's sealed rotary mechanism.
Figure 5:
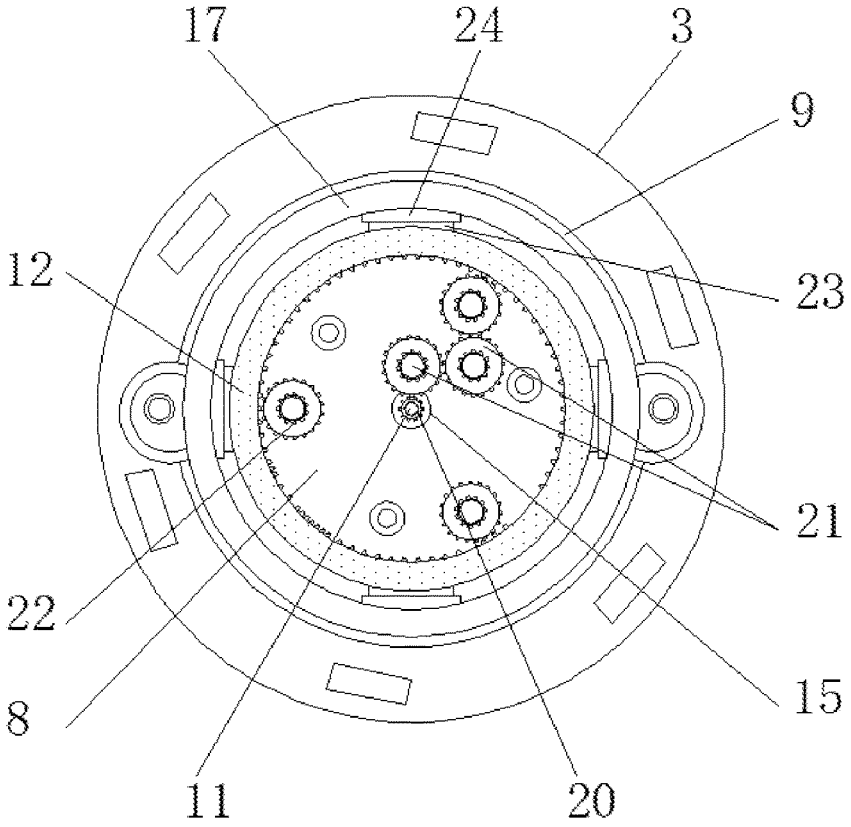
FIG. 5 shows the right sectional view of the invention's sealed rotary mechanism.
Figure 6:
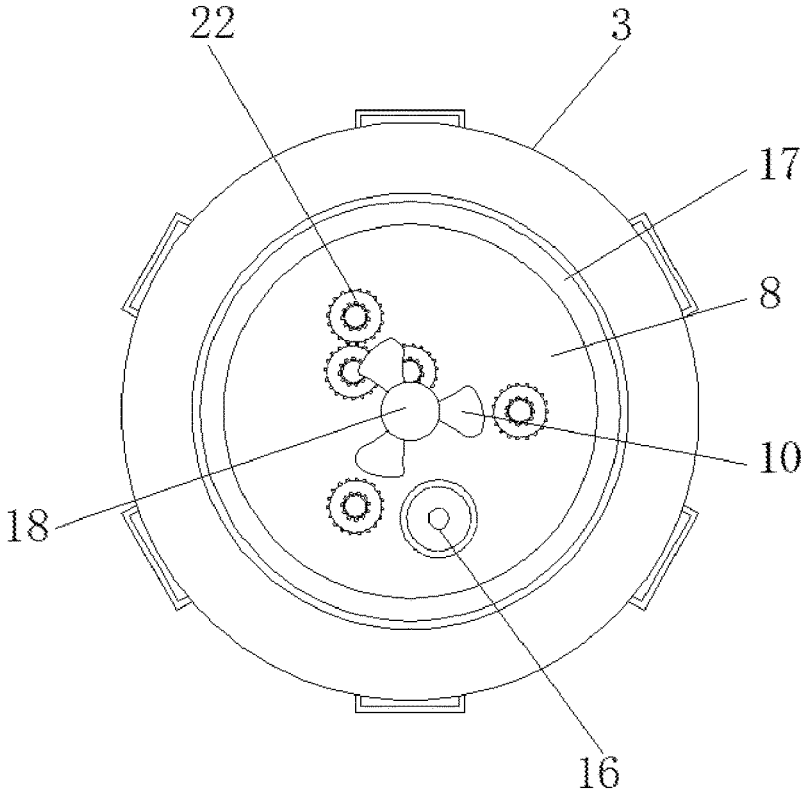
FIG. 6 shows the left sectional view of the invention's sealed rotary mechanism.
Figure 7:
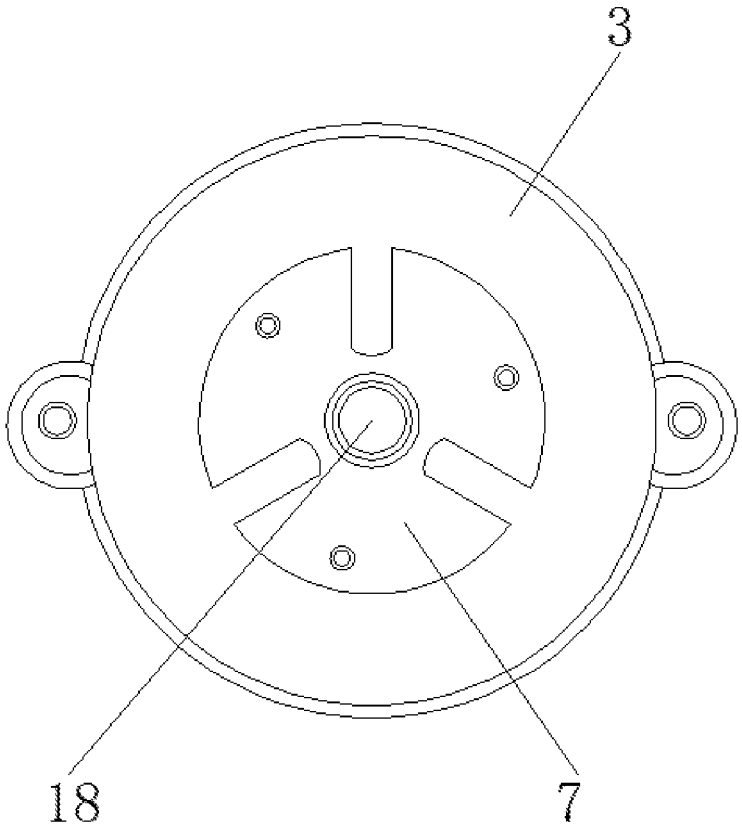
FIG. 7 shows the side view of the invention's magnetic rotor.

The working principle of the example: When using the interior rotating structure of the handicraft lantern, as shown in FIG. 1-2, the motor bracket 13 and motor body 14 are installed with the sealed rotary mechanism 3 using an external mounting tool. After the installation, connect the motor body 14 to an external power supply so that the motor body 14 can drive the motor shaft 11 to rotate. The rotating gear 20 outside the motor shaft 11 as shown in FIG. 5 drives the reduction gear set 21 to spin, and the rotation speed of the motor shaft 11 can be reduced by the rotation of the reduction gear set 21. The reduction gear set 21 drives the transmission gears 22 to rotate. As such, the transmission gears 22 slowed by the reduction gear set 21 drives the inner ring gear 12 of the external meshing connection to rotate, as shown in FIG. 5.

The inner ring gear 12 drives the impeller rotating bracket 17 to rotate through the attraction of the first magnets 23 and second magnets 24, so that the central impeller 10 inserted on the rear side of the impeller rotating bracket 17 spins through the fixing rod 18. Meanwhile, the impeller rotating bracket 17 drives the interior rotating bracket 6 to move. When the motor shaft (11) rotates, the shaft magnet 15 attracts the impeller magnet 16 on the central impeller 10 through the container sealing cover 9. The motor shaft can cause the central impeller 10 to rotate through the shaft magnet 15 and the impeller magnet 16 without directly coming into contact with the central impeller 10. Therefore, the central impeller 10 not only agitates the liquid in the transparent container 2, but also makes the liquid in the transparent container 2 flow. In addition, this results in the improved sealing performance of the entire rotating structure and the liquid in the transparent container 2 is prevented from leaking during the rotation.

The central impeller 10 can drive the central impeller frame 8 to rotate while the magnet impeller 16 on the central impeller frame 8 attracts the magnetic rotor 7. The central impeller frame 8 drives the interior rotating bracket 6 to rotate through the magnetic rotor 7, and the interior rotor 19 outside the interior rotating bracket 6 can rotate, causing the interior of the transparent container 2 to spin as well. Thus the rotating structure can operate normally in a well-sealed environment and rotate the liquid in the transparent container 2. Moreover, the ornamental and decorative value of the handicraft lantern improved and a series of other functions is achieved.

Even though the present invention has been described in detail with reference to the above examples, those who are skilled in this field may still make modifications to the technical schemes in the aforementioned examples, or replace some of the technical features. Any modifications, equivalent substitutions, and improvements made within the spirit and principles of the present invention shall be included in the protection scope of the present invention.

The invention claimed is:

1. An interior rotating structure of a handicraft lantern, which comprises a lantern bracket (1), a transparent container (2), a sealed rotary mechanism (3), a mounting frame (4), a rear cover (5), and a motor body (14) characterized by:

(a) the transparent container (2) being fixed under the lantern bracket (1);

(b) the sealed rotary mechanism (3) being inserted under the transparent container (2);

(c) the rear cover (5) being planted at a bottom end of the mounting frame (4);

(d) a container sealing cover (9) installed inside the sealed rotary mechanism (3);

(e) a central impeller (10) mounted on the container sealing cover (9);

(f) a central impeller frame (8) installed on the exterior of the central impeller (10);

(g) an interior rotating bracket (6) mounted on the exterior of the central impeller frame (8);

(h) a magnetic rotor (7) built at a bottom end of the interior rotating bracket (6);

(i) a motor shaft (11) penetrating the container sealing cover (9);

(j) a bottom end of the motor shaft (11) connected to the output end of the motor body (14) through the motor bracket (13);

(k) a shaft magnet (15) and a rotating gear (20) fixed on an outer side of the motor shaft (11), with an outer side of the rotating gear (20) meshed and connected to a reduction gear set (21);

(l) an outer side of the reduction gear set (21) meshed and connected to transmission gears (22);

(m) an outer side of the transmission gears (22) meshed and connected with an inner ring gear (12);

(n) first magnets (23) fixed on an outer side of the inner ring gear (12);

(o) second magnets (24) mounted on an outer side of the first magnets (23);

(p) an impeller rotating bracket (17) on an outer side of the second magnets (24), the interior rotating bracket (6) inserted on an outer and rear side of the impeller rotating bracket (17);

(q) the rear side of the impeller rotating bracket (17) connected to the central impeller (10) through a fixing rod (18);

(r) an interior rotor (19) fixed on the outer side of the interior rotating bracket (6); and (s) a magnet impeller (16) set on the rear side of the impeller rotating bracket (17).

2. The interior rotating structure of the handicraft lantern as described in claim 1, wherein the sealed rotary mechanism (3) is T-shaped, and is connected to the motor bracket (13) through screws.

3. The interior rotating structure of the handicraft lantern as described in claim 1, wherein the interior rotating bracket (6) and the sealed rotary mechanism (3) form a rotating structure through the fan-shaped magnetic rotor (7).

4. The interior rotating structure of the handicraft lantern as described in claim 1, wherein the container sealing cover (9) and the sealed rotary mechanism (3) are integrated, with the container sealing cover (9) linked to the central impeller frame (8) through a sliding connection.

5. The interior rotating structure of the handicraft lantern as described in claim 1, wherein the central impeller (10) and the central impeller frame (8) are configured to be detached through the fixing rod (18), the vertical central line of the fixing rod (18) coincides with the vertical central line of the central impeller frame (8), and the outermost sides of the central impeller (10) and magnetic rotor (7) are not on the same plane.

6. The interior rotating structure of the handicraft lantern as described in claim 1, wherein the inner ring gear (12) is equally distributed inside the transmission gears (22), and the inner ring gear (12) is fixed and connected to the impeller rotating bracket (17) through the first magnets (23) and the impeller rotating bracket (17).

7. The interior rotating structure of the handicraft lantern as described in claim 1, wherein the impeller rotating bracket (17) forms a rotating structure through the sealed rotary mechanism (3) and the inner ring gear (12), the side of the impeller rotating bracket (17) is ring-shaped and is connected to the interior rotating bracket (6) through welding.

8. The interior rotating structure of the handicraft lantern as described in claim 1, wherein the external diameter of each transmission gear (22) is larger than or equal to that of the reduction gear set (21), with three transmission gears installed.

9. The interior rotating structure of the handicraft lantern as described in claim 1, wherein the first magnets (23) and the second magnets (24) have different magnetic poles that make them attract.

* * * * *